US005618246A

United States Patent [19]

Zheng

[11] Patent Number: 5,618,246

[45] Date of Patent: Apr. 8, 1997

[54] COLLAPSIBLE PLAY TUNNEL STRUCTURES

[76] Inventor: Yu Zheng, 1065 Howard Ave., Covina, Calif. 91722

[21] Appl. No.: 500,488

[22] Filed: Jul. 10, 1995

[51] Int. Cl.[6] ..... A63B 71/02

[52] U.S. Cl. ..... 482/35; 135/126

[58] Field of Search ..... 135/125, 126, 135/127, 90, 95, 97; 138/123, 127, 129, 131; 472/62; 482/35, 148; 285/260, 150

[56] References Cited

U.S. PATENT DOCUMENTS

| | | | |
|---|---|---|---|
| 2,959,413 | 11/1960 | Rosenzweig | 482/35 |
| 3,895,796 | 7/1975 | Pestalozzi | 482/35 |
| 3,928,701 | 12/1975 | Roehner | 482/135 |
| 3,960,161 | 6/1976 | Norman | 135/126 |
| 4,629,182 | 12/1986 | Rader et al. | 482/35 |
| 5,031,652 | 7/1991 | Lester | 135/127 |
| 5,095,942 | 3/1992 | Murphy | 285/150 |
| 5,159,948 | 11/1992 | Moreau et al. | 135/125 |
| 5,343,887 | 9/1994 | Danaher | 135/126 |

OTHER PUBLICATIONS

135/97 Magic Maze Frontgate Summer 1995 p. 32.

*Primary Examiner*—Jerome Donnelly
*Attorney, Agent, or Firm*—Raymond Sun

[57] ABSTRACT

A collapsible tunnel structure having a connector including at least three loop members coupled to each other, each loop member defining an opening having a particular size and configuration. The tunnel structure further comprises at least one tunnel, each tunnel comprising a helically coiled wire supporting a covering which is attached to the wire to define a tunnel passageway having a first end and a second end. The first and second ends define openings each having a size and configuration which correspond to the size and configuration of the opening defined by at least one of the loop members of the connector. The second end of each tunnel is adapted to be connected to one of the loop members of the connector, and the opening defined by the first end of each tunnel is adapted for a child to crawl therethrough to enter the tunnel. The second end of each tunnel is connected to a corresponding loop member of the connector by at least one tie member provided at the second end.

11 Claims, 7 Drawing Sheets

COLLAPSIBLE PLAY TUNNEL STRUCTURES

BACKGROUND OF THE INVENTION

1. Field of the Invention

The present invention relates to play structures for children, and in particular to collapsible play tunnel structures through which children can crawl or climb therethrough. In their normal expanded configurations, the tunnel structures define a plurality of tunnel pathways. The tunnel structures may also be collapsed and folded into a compact configuration for easy transportation and storage.

2. Description of the Prior Art

Two important considerations for all toys or play things targeted for children are convenience and variety. Relating to convenience, a toy must be easily transportable so that the child can move it around the home, or even to other places outside of the home. A toy must also be easily stored since a child is likely to have many other toys that compete for precious storage space in the home. As for variety, a toy must offer enough variety in play so that the child will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space.

In the past, attempts have been made to provide play structures for the entertainment of children. Such play structures have been provided in many different shapes and sizes. For example, some have been shaped as playhouses to allow children to climb into and out of the structure. However, in order to provide a structure that can temporarily house a child, such a structure must be quite large and would be difficult to transport and store.

Another type of play structure that has been popular with children is a play tunnel. These play tunnels provide a long passageway or tunnel through which a child can crawl. These play tunnels are normally made by wrapping a piece of fabric about a helically-shaped metal loop, with the loop defining the shape of the tunnel. Since the metal loop is helical, the tunnel may be collapsed into a smaller configuration by pressing both ends of the tunnel against each other, and then tying both ends together. Unfortunately, these play tunnels do not provide much variety in play to the child, because it is either difficult or not possible to create a number of different passageways for the child to climb therethrough. Therefore, the child may become bored with a conventional play tunnel after a short period of time.

Thus, there remains a need for a play tunnel which may be adapted at the child's discretion to assume a plurality of different configurations for increased variety of play, and is convenient to use, to transport, and to store.

SUMMARY OF THE DISCLOSURE

In order to accomplish the objects of the present invention, the collapsible tunnel structure according to the present invention comprises a connector having at least three loop members coupled to each other, each loop member defining an opening having a particular size and configuration. The tunnel structure of the present invention further comprises at least one tunnel, each tunnel comprising a helically coiled wire supporting a covering which is attached to the wire to define a tunnel passageway having a first end and a second end. The first and second ends define openings each having a size and configuration which correspond to the size and configuration of the opening defined by at least one of the loop members of the connector. The second end of each tunnel is adapted to be connected to one of the loop members of the connector, and the opening defined by the first end of each tunnel is adapted for a child to crawl therethrough to enter the tunnel. The second end of each tunnel is connected to a corresponding loop member of the connector by at least one tie member provided at the second end.

Each loop member of the connector of the present invention is retained in a retaining sleeve, with each retaining sleeve connected to at least two adjacent retaining sleeves to define the connector. The connector further comprises an upper cover piece and a lower cover piece attached to the retaining sleeves. An opening is provided in each of the upper cover piece and the lower cover piece.

Each tunnel according to the present invention further comprises at least one tie member provided at the first end, the first end of each tunnel adapted to be compressed against the second end of that same tunnel, with the at least one tie member at the first end used to secure the particular tunnel in a compressed state against the connector.

In a preferred embodiment according to the present invention, the tunnel structure comprises four tunnels, and the connector comprises four loop members, with each of the first ends of the tunnels connected to one of the loop members of the connector. This tunnel structure can be collapsed or reduced to a smaller size by first compressing the first end of each tunnel against its second end. Each compressed tunnel is then secured against its corresponding loop member. Thereafter, two adjacent loop members of the connector and their corresponding compressed tunnels are pushed against the other two loop members and their corresponding compressed tunnels to form two stacks of compressed tunnels and loop members. The two stacks of compressed tunnels and loop members are then folded against each other to form one stack of compressed tunnels and loop members. The resulting one stack of compressed tunnels and loop members are then secured together.

In another preferred embodiment according to the present invention, the tunnel structure comprises four tunnels and four connectors, each of the first and second ends of each tunnel connected to a loop member of a different connector, and with each connector having at least one free loop member which does not have a tunnel connected thereto to define an opening for entry or exit into the tunnel structure.

A plurality of the tunnels and the connectors according to the present invention may be provided to create tunnel structures of different configurations. In addition, the tunnels and connectors may be provided in different shapes and sizes, and a particular connector could be provided with loop members having different shapes and sizes. Alternatively, a tunnel structure may be provided that has a plurality of tunnels and connectors integrally connected to form one unitary tunnel structure which may be compressed and collapsed according to the same principles described herein.

Thus, the tunnel structures of the present invention provide a child with much play variety. The tunnel structures according to the present invention are also convenient for use since they are easily and quickly folded and collapsed into a smaller size for transportation and storage.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
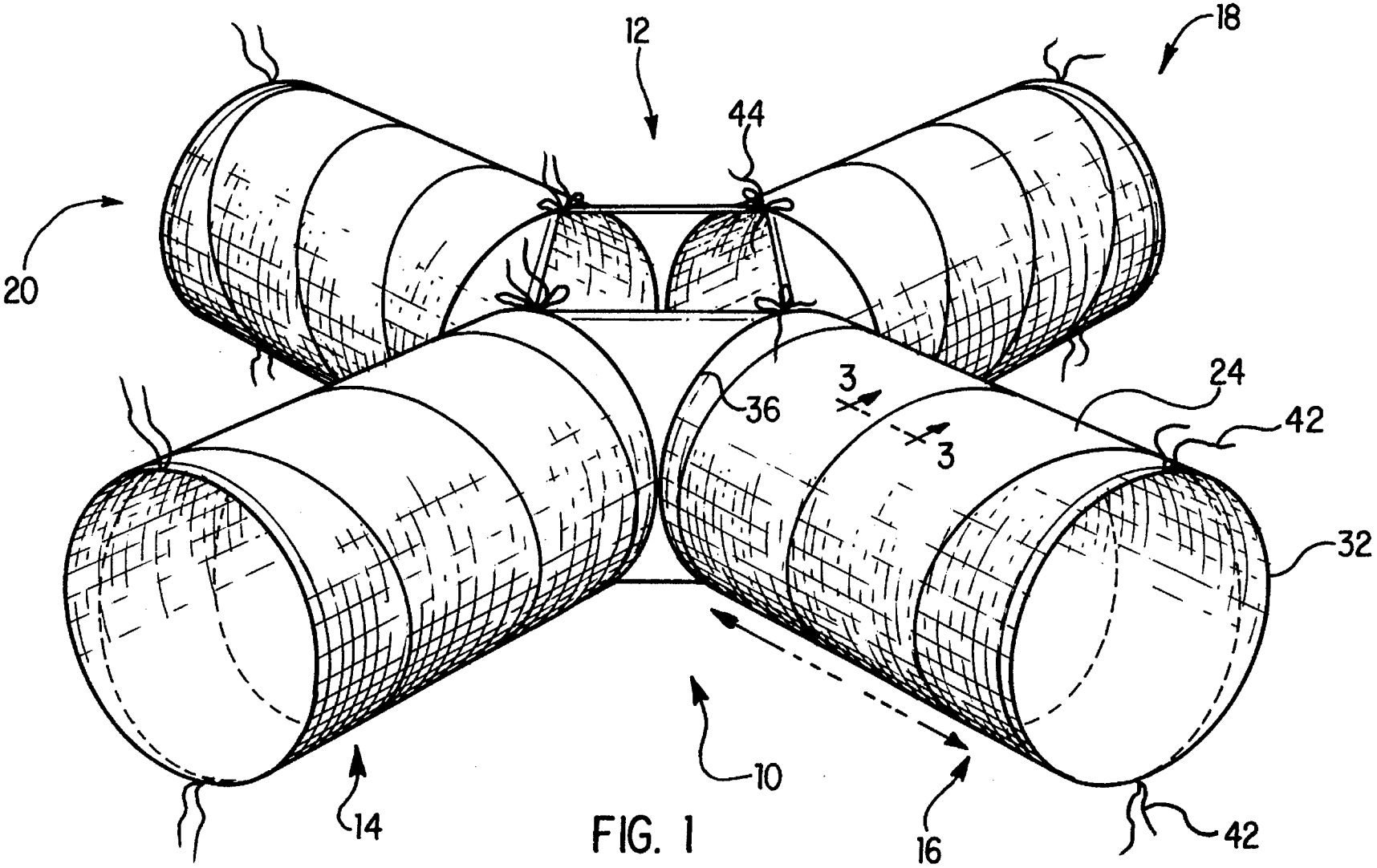
FIG. 1 is a perspective view of a collapsible play tunnel structure according to a first preferred embodiment of the present invention illustrated as having four separate collapsible tunnels connected to one connector.
Figure 2:
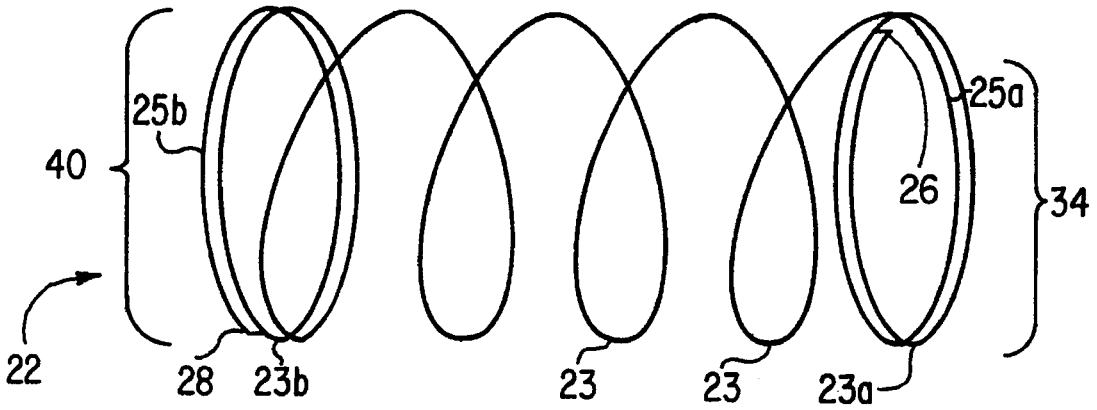
FIG. 2 is a perspective view of an internal wire that is used to define and support any of the collapsible tunnels of FIG. 1.
Figure 3:
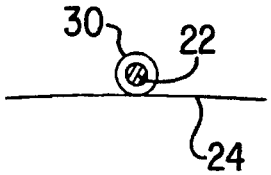
FIG. 3 is a cross-sectional view of a tunnel of FIG. 1 taken along line 3—3 thereof.

As shown in FIGS. 1–3, a collapsible play tunnel structure 10 according to a first embodiment of the present invention comprises a connector 12 and four separate collapsible tunnels 14, 16, 18 and 20. The four collapsible tunnels 14, 16, 18 and 20 may be attached to the connector 12 to form a tunnel structure 10 illustrated in FIG. 1 that provides a child with one intersection (the connector 12) and four separate passageways (the tunnels 14, 16, 18 and 20) to crawl through.

The tunnels 14, 16, 18 and 20 are illustrated as having the same structure and configuration so that a plurality of these tunnels may be provided with a plurality of identical connectors 12 for assembly into a plurality of different configurations, as described in greater detail hereinbelow.

Each tunnel 14, 16, 18 and 20 comprises an internal support wire 22 supporting a covering 24 which is attached to the wire 22 to define the tunnel passageway. The wire 22 is helically coiled, with the adjacent coils 23 being normally biased in spaced apart relation, as shown in FIG. 2. The wire 22 defines a first end 26 and a second end 28. At the first and second ends 26 and 28, the wire 22 extends past the outer coil 23*a* and 23*b*, respectively, so that a segment 25*a* and 25*b* at each end 26, 28 of the wire 22 overlaps with the outer coil 23*a* and 23*b*, respectively.

The covering 24 is attached to the wire 22 by gluing, stitching, fusing, mechanically fastening or other conventional attachment methods. Alternatively, as shown in FIG. 3, a sleeve 30 may be stitched or otherwise provided along the covering 24 with the wire 22 housed or attached therein. The first end 26 of the wire 22 terminates at a first substantially circular edge 32 of the covering 24. The outer coil 23*a* of the first end 26 forms a substantially circular end wire portion 34 to provide support to the first edge 32 of the covering 24. Similarly, the second end 28 of the wire 22 terminates at a second substantially circular edge 36 of the covering 24. The outer coil 23*b* of the second end 28 forms another substantially circular end wire portion 40 to provide support to the second edge 36. The circular end wire portions 34 and 40 and their respective circular edges 32 and 36 each defines an opening through which a child may crawl to enter the tunnel.

The overlapping segment 25*a* may be attached to the outer coil 23*a* along the length of the segment 25*a*, or the outer coil 23*a* and the overlapping segment 25*a* at the first end 26 of the wire 22 may be retained in the same sleeve 30. Similarly, the overlapping segment 25*b* may be attached to the outer coil 23*b* along the length of the segment 25*b*, or the outer coil 23*b* and the overlapping segment 25*b* at the second end 28 of the wire 22 may retained in the same sleeve 30.

A first set of tie members 42 are provided in spaced-apart manner along the first edge 32, and a second set of tie members 44 are provided in spaced-apart manner along the second edge 36. Each tie member 42, 44 comprises two strings or thin pieces of fabric which can be tied together to create a knot. Each set of tie members 42, 44 could comprise any number of tie members, but preferably comprises at least two tie members. In addition, each edge 32 and 36 preferably comprises two sets of tie members, although any number of sets of tie members can be utilized at each edge 32 and 36 without departing from the spirit and scope of the present invention.

The wire 22 is preferably made from a strong yet springy metal, such as steel or iron, but also can be made from other strong and coilable materials, such as fiberglass or plastic. Such materials are preferably capable of allowing the wire 22 to maintain its coiled shape. The covering 24 is preferably made from a strong durable fabric, such as cotton, canvas, mesh or net, but can also be made from other strong durable materials such as PVC or plastic. The term fabric is to be given its broadest meaning and should be made from strong, lightweight materials and may include woven fabrics, sheet fabrics or even films. The covering 24 should be water-resistant and durable to withstand the wear and tear associated with rough treatment by children.

Figure 4:
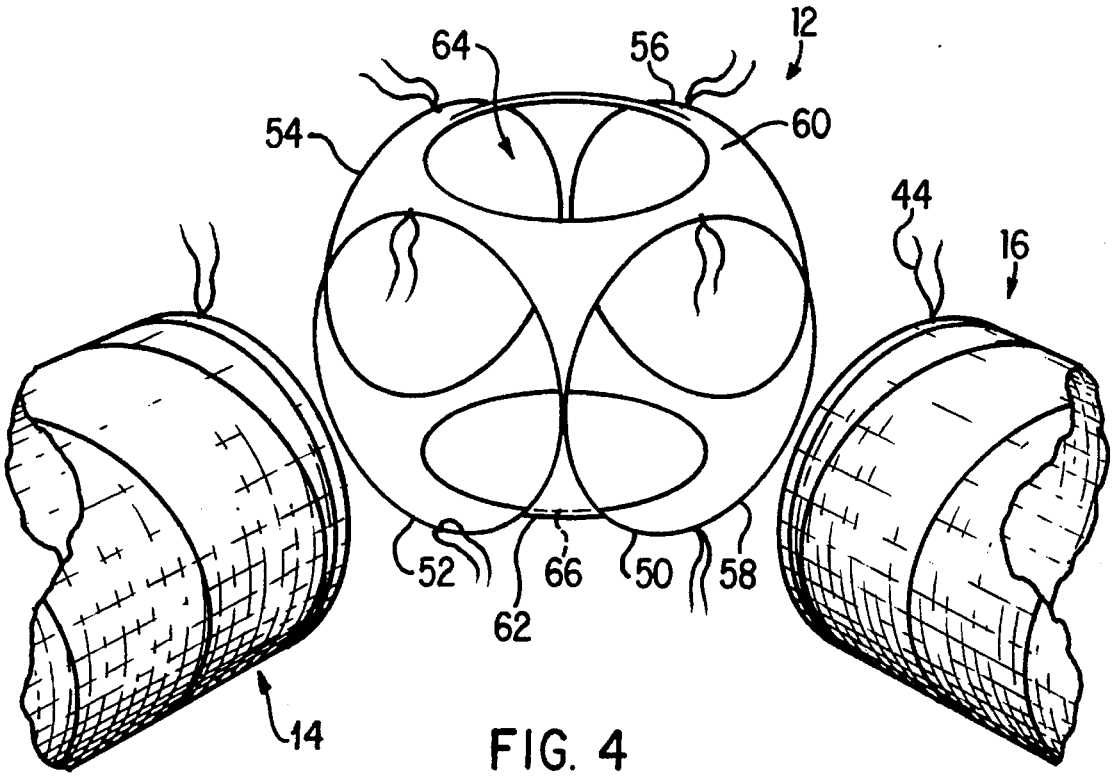
FIG. 4 is an exploded perspective view of the collapsible tunnel structure of FIG. 1 in which only two of the four tunnels are illustrated.

Referring to FIG. 4, the connector 12 comprises four identical substantially circular loop members 50, 52, 54 and 56. Each loop member 50, 52, 54 and 56 is preferably made from the same material as the wires 22 of the tunnels 14, 16, 18 and 20, but can also be made from any of the other materials described hereinabove. Each loop member 50, 52, 54, 56 is housed or otherwise retained inside a retaining sleeve 58. The retaining sleeves 58 for the loop members 50, 52, 54 and 56 are attached to each other by stitching, mechanically fastening or other conventional attachment methods so that the four loop members 50, 52, 54 and 56 form a four-sided configuration, as shown in FIG. 4, which is the basic configuration for the connector 12. Specifically, each retaining sleeve 58 is attached to the two adjacent retaining sleeves 58. Although not necessary, an upper cover piece 60 and a lower cover piece 62 may be stitched, fastened, glued, or otherwise attached to the upper and lower edges, respectively, of the four retaining sleeves 58 to provide additional support and integrity for the connector 12. The upper and lower cover pieces 60 and 62 are preferably made from the same material as the covering 24 of the tunnels 14, 16, 18 and 20, but can also be made from any of the other materials described hereinabove. Openings 64 and 66 (66 shown in phantom) are provided in the cover pieces 60 and 62, respectively, to allow a child to crawl therethrough. It will be understood that one of the cover pieces 60 or 62 will be rested on the ground when in use, depending on how the user orients the connector 12.

Each circular loop member 50, 52, 54 and 56 is adapted to receive or be connected to a circular end wire portion 34 or 40 of each tunnel 14, 16, 18 and 20. Therefore, each circular loop member 50, 52, 54 and 56 preferably has substantially the same size and configuration as the circular end wire portions 34 and 40. The tie members 42 or 44 are used to connect the particular circular end wire portion 34 or 40 to the intended circular loop member 50, 52, 54 or 56. Specifically, referring to FIGS. 1 and 4, the second edge 36 of a circular end wire portion 40 of a tunnel 16 is positioned against and aligned with a particular circular loop member 50. Both strings of each tie member of the second set of tie members 44 are then passed through the openings 64 and 66 and tied to secure the tunnel 16 to the loop member 50 of the connector 12. The other tunnels 14, 18 and 20 are attached to the connector 12 using the same method. When so attached, the collapsible tunnel structure 10 comprises four separate tunnel passageways that branch from a central connector, thereby providing a child with four separate passageways to crawl through or explore. The child may enter or exit through the upper opening 64 or any of the openings defined by the first edge 32 of any of the tunnels 14, 16, 18 or 20. This provides the child with much variety in play since the child is presented with many different passageways to explore, and many openings through which the child may enter or exit. It will be understood that both ends 26, 28 of the wire 22 are symmetrical. Therefore, either the first end 26 or the second end 28 can be used to connect the tunnel 14, 16, 18 or 20 to the connector 12.

Alternatively, the tunnel structure 10 can be provided in one integral structure. When so provided, the loop members 50, 52, 54 and 56, and one set of the tie members 42 or 44, can be omitted, and the upper and lower cover pieces 60 and 62 may be attached by stitching, fusing, mechanically fastening or other conventional means to the second circular edges 36 of the tunnels 14, 16, 18 and 20. Thus, the upper and lower cover pieces 60 and 62 operate to connect the tunnels 14, 16, 18 and 20 together.

Figure 5:
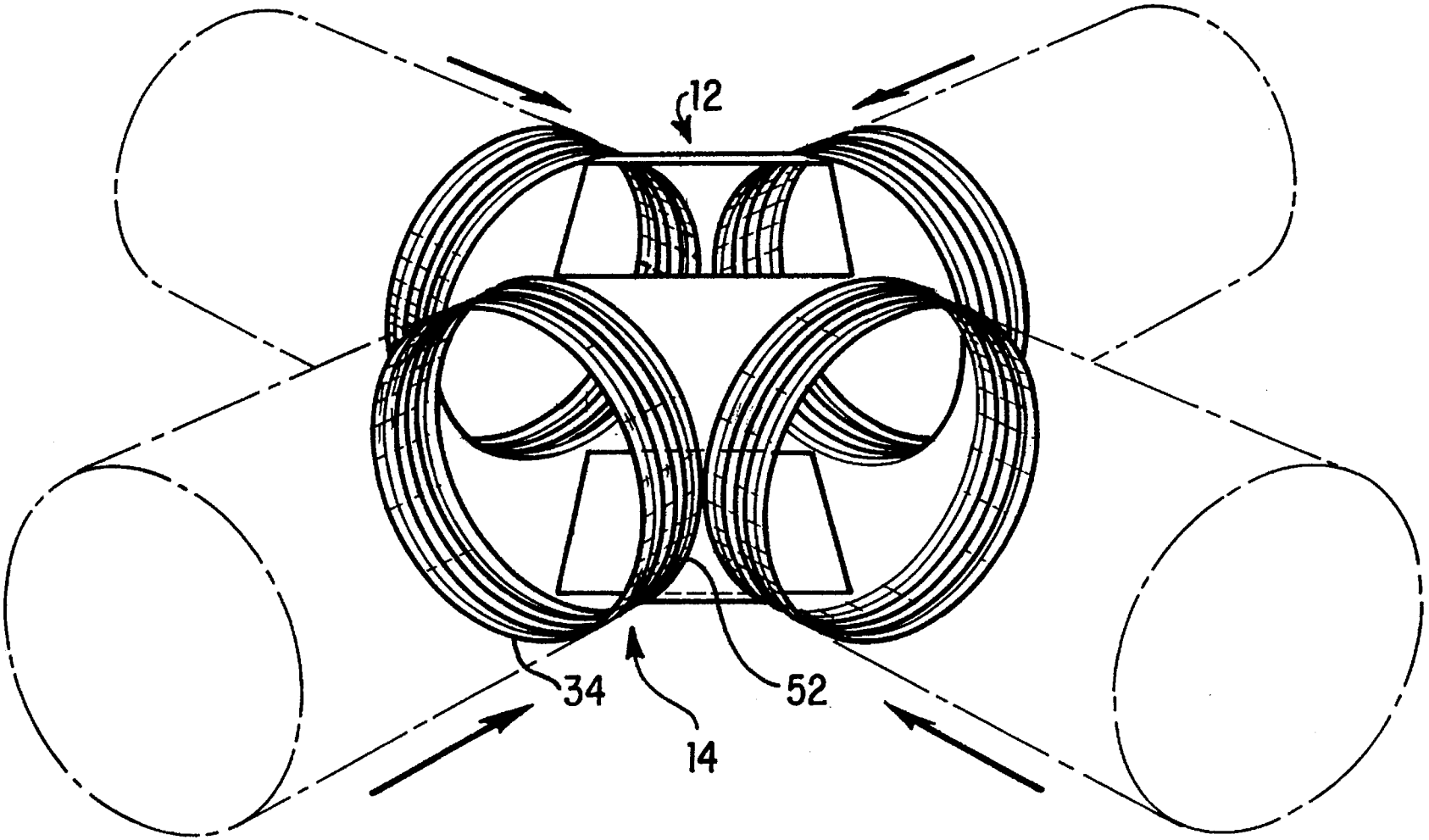
FIGS. 5–7 illustrate how the collapsible tunnel structure of FIG. 1 may be collapsed and folded for compact storage.

The collapsible tunnel structure 10 can be easily collapsed and folded for storage. In the first step shown in FIG. 5, each of the tunnels 14, 16, 18 and 20 are compressed against the connector 12. Specifically, to compress a tunnel, for example, tunnel 14, the user grips the circular end wire portion 34, or the first edge 32, of the tunnel 14 with one hand, and while using the other hand to grip the corresponding loop member 52 and attached end wire portion 40, pushes or compresses the end wire portion 34 against the end wire portion 40. This compresses the plurality of helical coils of the wire 22 against each other. This compression is made possible by the springy nature of the wire 22, and its helically coiled configuration. With the wire 22 compressed, both strings of each tie member of the first set of tie members 42 are passed through the openings 64 and 66 in the connector 12 and tied to secure the tunnel 14 to the loop member 52. The other tunnels 16, 18 and 20 are compressed and tied to the connector 12 in the same manner, which results in the tunnel structure 10 shown in FIG. 5.

Figure 6:
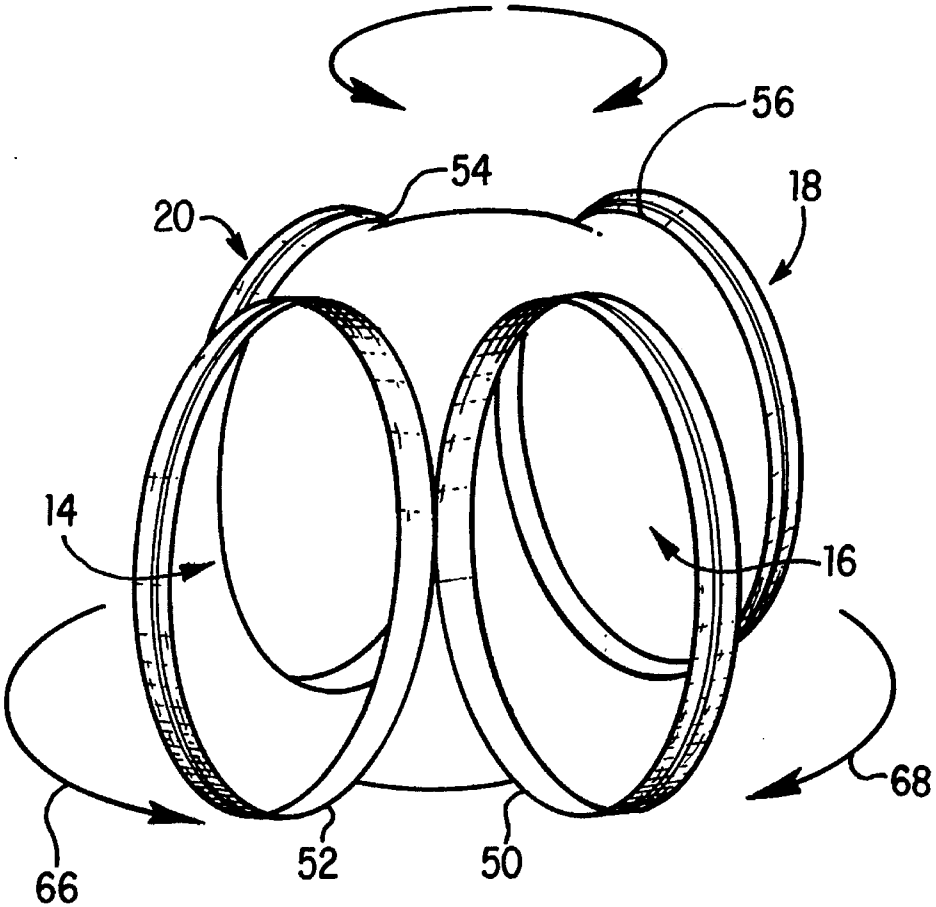

In the second step shown in FIG. 6, adjacent tunnels 14 and 16, and their respective loop members 52 and 50 are pushed against loop members 54 and 56, respectively, and their respective tunnels 20 and 18 so that loop member 52 is pushed against loop member 54, and loop member 50 is pushed against loop member 56. The direction arrows 66 and 68 indicate the direction of the pushing or folding. This results in two stacks of compressed tunnels and loop members.

Figure 7:
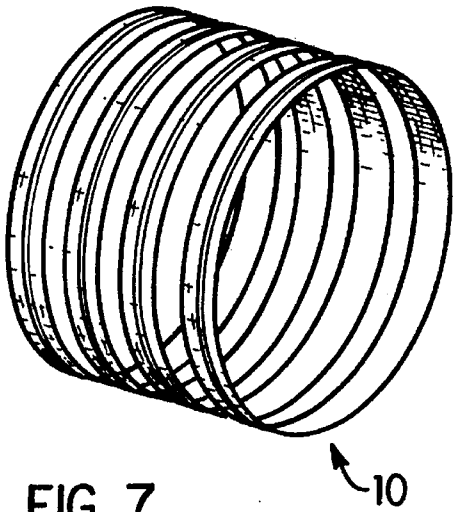

Then, in the third step, the combined compressed tunnels 14 and 20, and their respective loop members 52 and 54, are folded or pushed against combined compressed tunnels 16 and 18 and their respective loop members 50 and 56, to form one final stack of compressed tunnels and loop members. A string, tie member, or other securing mechanism may be passed through the openings defined by the end wire portions 34 and 40 of the tunnels 14, 16, 18 and 20 and used to tie together the four loop members 50, 52, 54 and 56 and their corresponding tunnels 14, 16, 18 and 20. This results in the configuration shown in FIG. 7, in which the tunnel structure 10 is in a compact configuration having a plurality of loop members 50, 52, 54 and 56 and collapsed wires 22 of the tunnels 14, 16, 18 and 20 so that the collapsed tunnel structure has a size which is a fraction of the size of the initial tunnel structure. This resulting tunnel structure 10 may be easily transported or stored.

The dimensions of the connector 12 and the tunnels 14, 16, 18 or 20 are not critical, but must be large enough for a toddler to crawl therethrough. The dimensions will also depend on the type of children targeted. For example, a collapsible tunnel structure 10 targeted at infants may be smaller than one that is targeted at older children.

Further, the configurations of the connector 12 and tunnels 14, 16, 18 and 20 can be varied without departing from the spirit and scope of the present invention. For example, the connector 12 is not required to have only four loop members defining the square or four-sided configuration shown in FIGS. 1 and 4, but may comprise two, three, five or even a greater number of loop members to define a triangular or other polygonal configuration. Similarly, the tunnels 14, 16, 18 and 20 need not necessarily be substantially straight, as shown in FIGS. 1 and 4, but can assume other configurations such as an L-shaped, S-shaped, U-shaped, or other configurations. This can be accomplished by providing the internal support wire 22 in the desired configuration and then attaching the covering 24 to it to form the tunnel. Further, the length of the tunnels can be varied to form tunnel passageways of different lengths. As a further example, the tunnels 14, 16, 18 and 20 and the loop members 50, 52, 54 and 56 do not necessarily need to be substantially circular, but can assume a square, rectangular, triangular, polygonal or other shape. This can accomplished by coiling the internal support wire 22 to the desired shape and then attaching the covering 24 to it to form the tunnel. Moreover, any combination of modifications described hereinabove may be utilized to provide connectors 12 and tunnels 14, 16, 18 and 20 of varying shapes and sizes without departing from the spirit and scope of the present invention. Each connector 12 can also be provided with loop members of different shapes and sizes to facilitate use with tunnels of different shapes and sizes.

Figure 8:
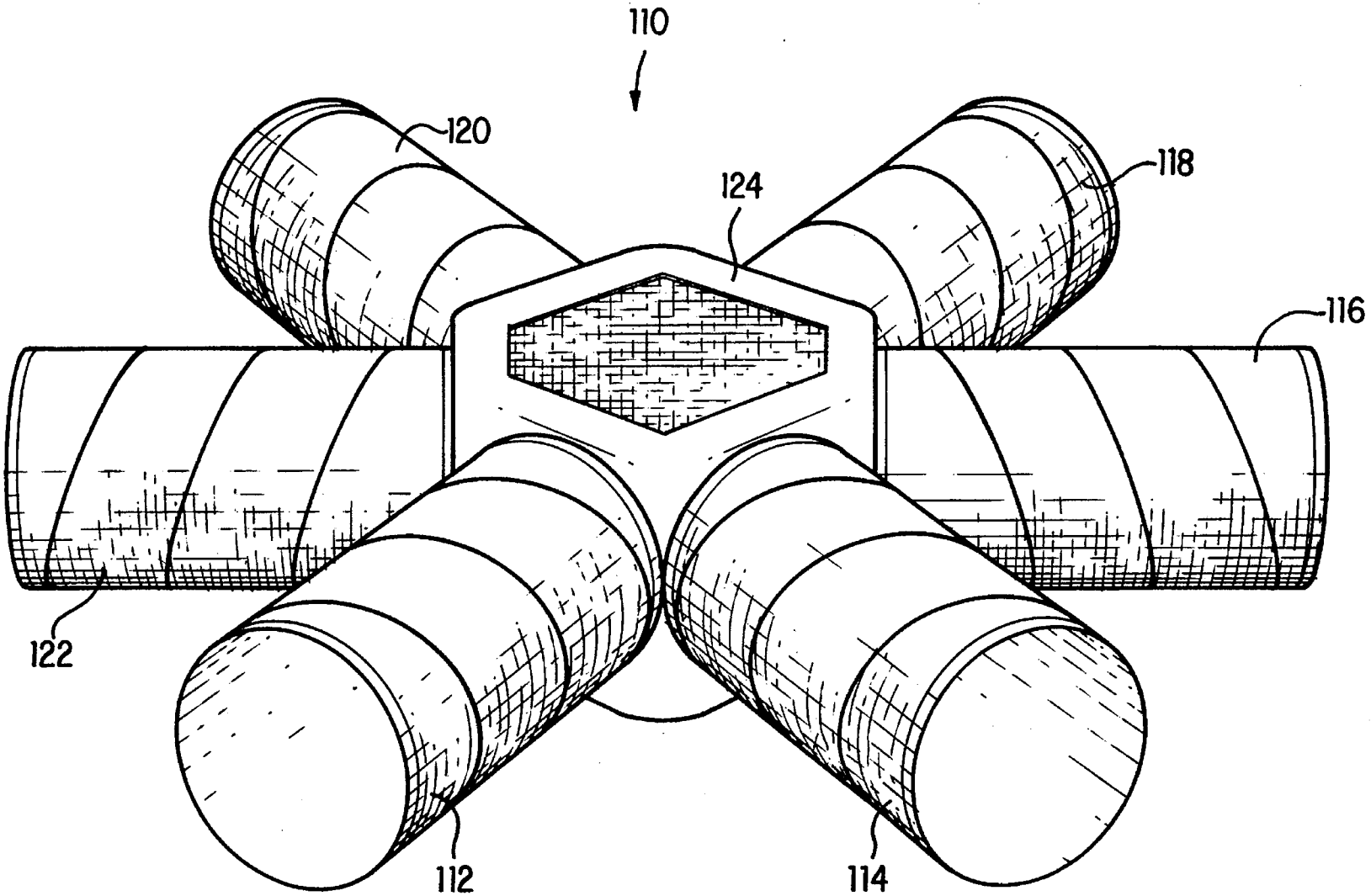
FIG. 8 is a perspective view of a collapsible play tunnel structure according to a second preferred embodiment of the present invention illustrated as having six separate collapsible tunnels connected to one connector.

One example is illustrated in FIG. 8, in which a collapsible tunnel structure 110 has six tunnels 112, 114, 116, 118, 120 and 122 connected to a connector 124 that has six openings that are adapted to receive or connect the six tunnels 112, 114, 116, 118, 120 and 122.

Figure 10:
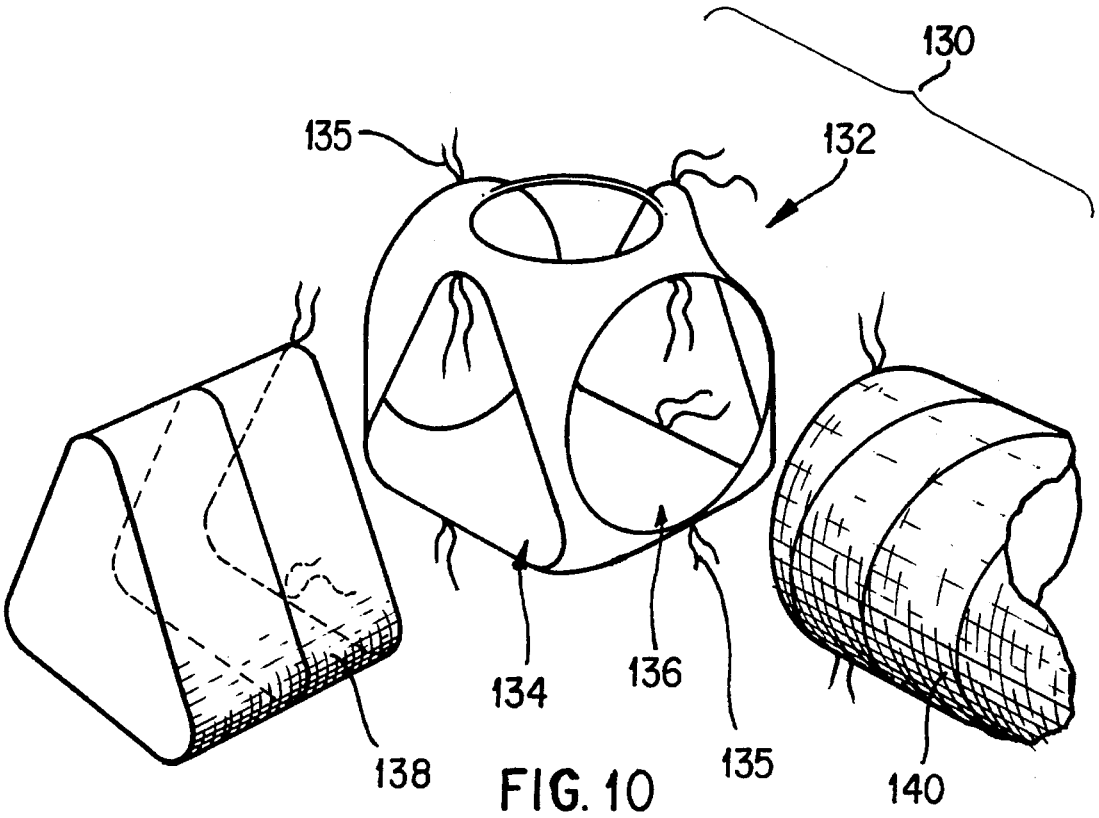
FIG. 10 is a perspective view of a collapsible play tunnel structure according to a fourth preferred embodiment of the present invention illustrated as having a connector with openings of different configuration.

Yet another example is illustrated in FIG. 10, in which a collapsible tunnel structure 130 comprises a connector 132 that has openings of different configurations. For example, one opening 134 is substantially triangular and another opening 136 is substantially circular. A substantially triangular tunnel 138 is shown as being adapted for connection at opening 134, while a substantially circular tunnel 140 is shown as being adapted for connection at opening 136. Tie members 135 are provided at each opening 134 and 136.

Figure 11:
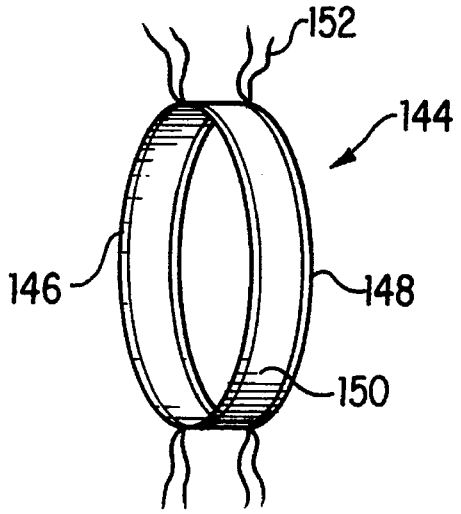
FIG. 11 is a perspective view of a connector according to a fifth preferred embodiment of the present invention.

A further example is illustrated in FIG. 11, which shows a connector 144 that has two openings directly opposite each other. The connector 144 comprises two loop members 146 and 148 housed in retaining sleeves that are connected by a covering 150. Tie members 152 are provided at each loop member 146 and 148.

The connector 12 and the separate tunnels 14, 16, 18, 20 according to the present invention may be provided as separate components and then utilized to form an infinite variety of different tunnel structures having different configurations. Further, although each connector 12 has four loop members 50, 52, 54 and 56 each defining a separate opening, it will be appreciated that not all the loop members 50, 52, 54 and 56 need to have a tunnel connected thereto, and that one or more of these loop members 50, 52, 54 and 56 can be left free or open to provide openings through which a child can enter.

Figure 9:
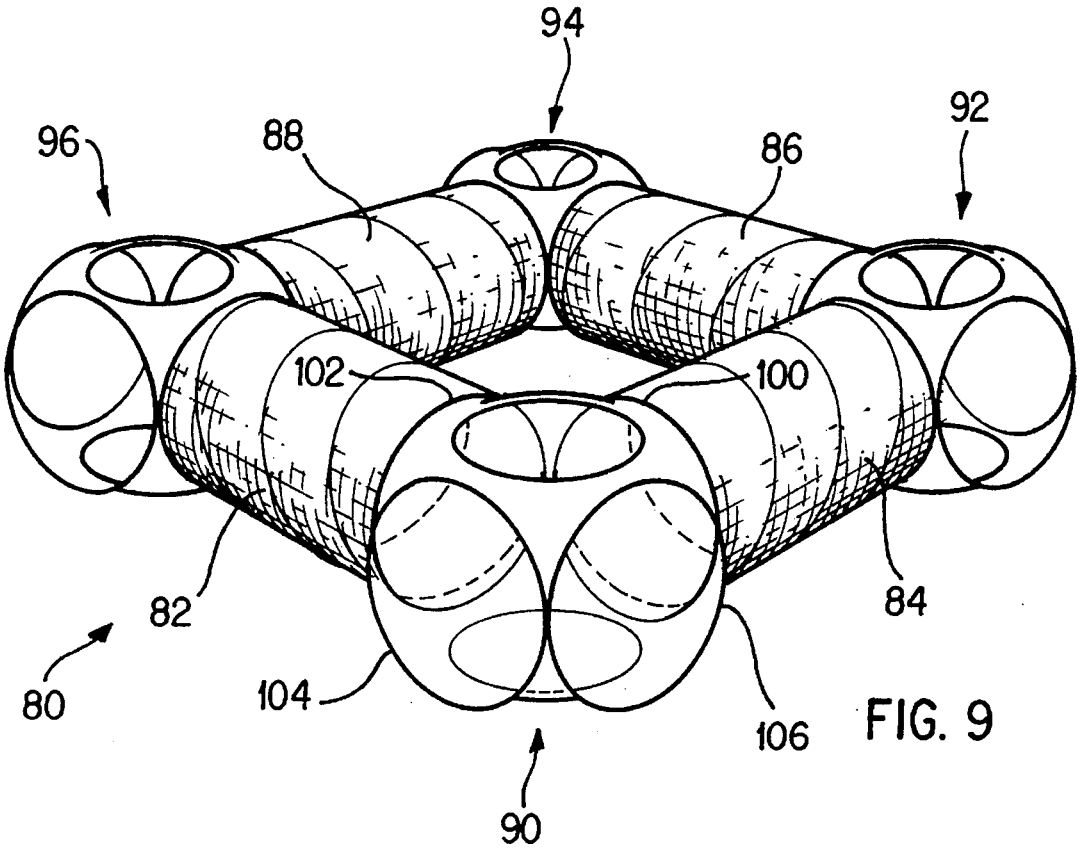
FIG. 9 is a perspective view of a collapsible play tunnel structure according to a third preferred embodiment of the present invention illustrated as having four separate collapsible tunnels connected to four connectors.

For example, a tunnel structure 80 according to another preferred embodiment of the present invention is shown in FIG. 9 and comprises four tunnels 82, 84, 86 and 88, and four connectors 90, 92, 94 and 96, configured as a four-sided or square structure. Specifically, each connector 90, 92, 94 and 96 has two tunnels connected to it at two of its four loop members, while the other two loop members are not used to connect tunnels and which are left free or open to define openings through which a child may enter or exit. Referring specifically to connector 90, tunnels 84 and 82 are connected to loop members 100 and 102, respectively, while loop members 104 and 106 are free and define openings. Both ends of each tunnel 82, 84, 86 and 88 are connected to a different connector 90, 92, 94 or 96 by any of the methods described above, and none of the ends of the tunnels 82, 84, 86 and 88 are free or open. Thus, the tunnel structure 80 defines eight openings, two at each of the connectors 90, 92, 94 and 96, through which a child may enter or exit, and at each opening, the child has a choice of two separate tunnel passageways through which he or she can traverse.

The tunnel structure 80 may be packed and collapsed by first detaching or removing the attached tunnels from two of the connectors, thereby creating two free connectors. For example, tunnels 82 and 84 may be detached from the connector 90, and tunnels 86 and 88 detached from the connector 94. The tunnels 82, 84 and 86, 88 may be removed from the connectors 90 and 94, respectively, by untying the appropriate tie members. This creates two free connectors 90 and 94 and two L-shaped tunnel structures, one defined by the tunnels 82 and 88 and the connector 96, and the other defined by the tunnels 84 and 86 and the connector 92. The tunnel pairs 82, 88 and 84, 86 may be compressed against their respective connectors 96 and 92 and folded or collapsed in the manner described above. It will be appreciated that any two connectors 90, 92, 94 or 96 may be selected to be the free connectors, with the appropriate tunnels 82, 84, 86 or 88 being detached to facilitate the packing process described above.

Alternatively, the tunnel structure 80 of FIG. 8 can be comprised of two L-shaped tunnels and two connectors. Specifically, each L-shaped tunnel can be defined by two tunnels and their connecting connector. For example, one L-shaped tunnel can be defined by the tunnels 82 and 88 and the connector 96, and the other L-shaped tunnel can defined by the tunnels 84 and 86 and the connector 92, so that only two connectors 90 and 94' are needed. This merely illustrates the variety and flexibility that a combination of the connectors and tunnels of the present invention provides to a child.

Figure 12:
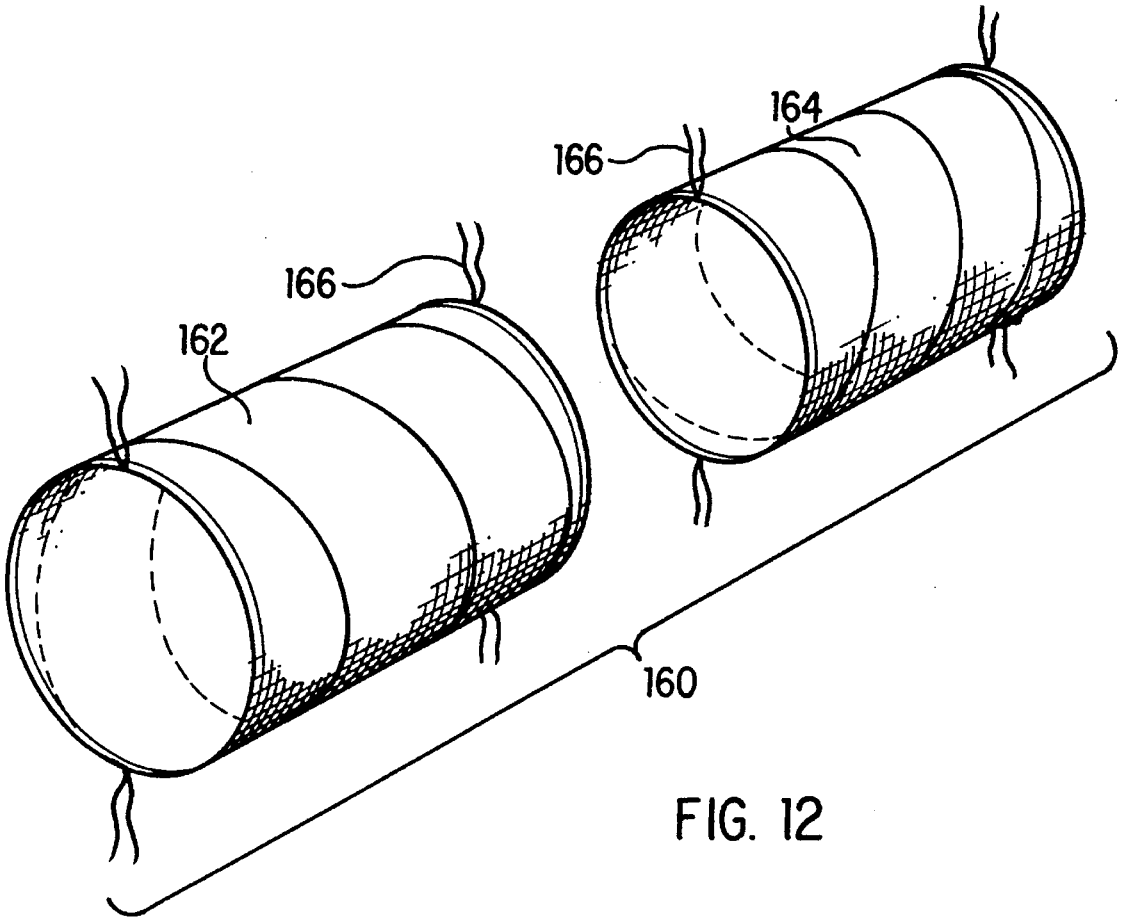
FIG. 12 is a perspective view of a collapsible play tunnel structure according to a sixth preferred embodiment of the present invention illustrated as having two tunnels connected without a connector.

In addition to the above-described alternatives, it will be understood by those skilled in the art that even the connectors can be omitted from the tunnel structure according to the present invention. For example, FIG. 12 illustrates a tunnel structure 160 which comprises two tunnels 162 and 164 connected together by their respective tie members 166. In this embodiment, no connector is needed.

The connectors and tunnels illustrated in FIGS. 8–12 above may be made in accordance with the principles described hereinabove for the connector and tunnels of FIGS. 1–4.

Thus, for the collapsible tunnel structures according to the present invention, the separate connectors 12 and tunnels 14, 16, 18 and 20 may be provided or purchased on an individual basis so that a child may be able to create a tunnel structure of a desired shape and size. Alternatively, a specific number of different connectors 12 and tunnels 14, 16, 18 and 20 may be packaged and sold together. However, it will be appreciated that only one connector 12 and one tunnel 14 is necessary to create a tunnel structure according to the present invention. In either case, the child will have the opportunity to create an endless variety of tunnel structures at his or her disposal, thereby enhancing the amusement value of the tunnel structures, and stimulating creativity in the child by challenging the child to create as many different tunnel structures as possible.

Further, the structure and configuration of the connectors and the tunnels according to the present invention allow any resulting tunnel structure to be easily folded and collapsed for transportation and storage.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible tunnel structure comprising:

a connector comprising at least two loop members coupled to each other, each loop member defining an opening having a particular size and configuration; and at least one tunnel, each of said at least one tunnels comprising a coiled wire supporting a covering which is attached to the wire to define a tunnel passageway, each coiled loop and its covering having a first end and a second end, the first and second ends defining openings having a size and configuration which correspond to the size and configuration of the opening defined by at least one of the loop members of the connector;

wherein the second end of each of said at least one tunnels includes at least one connection member and is connected to one of said loops of said connector by said connection member and at least one connection member provided at the first end of each of said at least one tunnels and wherein the first end of each of said at least one tunnels is adapted to be compressed against the second end of the same tunnel, with the at least one connection member at the first end used to secure the particular tunnel in a compressed state against the connector.

2. The structure of claim 1, wherein each loop member of the connector is retained in a retaining sleeve, and wherein each retaining sleeve is connected to at least two adjacent retaining sleeves to define the connector.

3. The structure of claim 2, wherein the connector further comprises an upper cover piece and a lower cover piece attached to the retaining sleeves.

4. The structure of claim 3, further comprising an opening provided in each of the upper cover piece and the lower cover piece.

5. The structure of claim 2, wherein the first and second ends of each wire comprises an outer wire portion and an overlapping segment that overlaps the outer wire portion.

6. The structure of claim 2, wherein each wire of each of said at least one tunnels is helically coiled.

7. The structure of claim 1, wherein each of said at least one tunnels comprises four tunnels, and wherein the connector comprises four loop members, wherein each of the second ends of the tunnels is connected to one of the loop members of the connector.

8. The structure of claim 1, wherein each of said at least one tunnels comprises six tunnels, and wherein the connector comprises six loop members, wherein each of the second ends of the tunnels is connected to one of the loop members of the connector.

9. The structure of claim 1, further comprising four tunnels and four connectors, each of the first and second ends of each tunnel connected to a loop member of a different connector, and with each connector having at least one free loop member which does not have a tunnel connected thereto to define an opening for entry into or exit from the tunnel structure.

10. The structure of claim 1, wherein each opening of the connector has a shape that is different from the shape of the other openings.

11. A method of collapsing a collapsible tunnel structure comprising a connector having four loop members coupled to each other, each loop member defining an opening having a particular size and configuration, the collapsible tunnel structure further comprising four tunnels, each tunnel comprising a coiled wire supporting a covering which is attached to the wire to define a tunnel passageway having a first end and a second end, the first and second ends defining openings each having a size and configuration which correspond to the size and configuration of the opening defined by at least one of the loop members of the connector, wherein the second end of each tunnel is connected to one of the loop members of the connector, the method comprising the steps of:

(a) compressing the first end of each tunnel against its second end;

(b) securing each compressed tunnel against its corresponding loop member;

(c) pushing two adjacent loop members of the connector and their corresponding compressed tunnels against the other two loop members and their corresponding compressed tunnels to form two stacks of compressed tunnels and loop members;

(d) folding the two stacks of compressed tunnels and loop members against each other to form one stack of compressed tunnels and loop members; and (f) securing the resulting one stack of compressed tunnels and loop members together.

* * * * *